US006194348B1

(12) United States Patent
Onishi et al.

(10) Patent No.: US 6,194,348 B1
(45) Date of Patent: Feb. 27, 2001

(54) THERMAL TRANSFER SHEET

(75) Inventors: Jiro Onishi; Hideki Usuki, both of Shinjuku-Ku (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 09/163,557

(22) Filed: Sep. 30, 1998

(30) Foreign Application Priority Data

Oct. 2, 1997 (JP) ..... 9-286173

(51) Int. Cl.[7] ..... B41M 5/035; B41M 5/38

(52) U.S. Cl. ..... 503/227; 428/195; 428/207; 428/328; 428/346; 428/352; 428/354; 428/913; 428/914

(58) Field of Search ..... 8/471; 428/195, 428/913, 914, 207, 323, 328, 343, 346, 352, 354; 503/227

(56) References Cited

U.S. PATENT DOCUMENTS 5,006,502 * 4/1991 Fujimura et al. ..... 503/227
5,965,485 * 10/1999 Mizumachi et al. ..... 503/227

* cited by examiner

*Primary Examiner*—Bruce H. Hess
(74) *Attorney, Agent, or Firm*—Parkhurst & Wendel, L.L.P

(57) ABSTRACT

This invention provides a thermal transfer sheet causing little static electricity during transfer onto a material as a transfer image support, and printed matter excellent in antistatic properties. The thermal transfer sheet comprises a protective transfer layer provided in at least part of one surface of a base sheet via a nontransferable release layer so as to be peelable, and has an antistatic agent contained in at least one of the release layer and the protective transfer layer. Printed matter is prepared by transferring the protective transfer layer from the above thermal transfer sheet onto an image formed on a substrate by a sublimation transfer process so as to cover at least part of the image.

10 Claims, 2 Drawing Sheets

THERMAL TRANSFER SHEET

BACKGROUND OF THE INVENTION

This invention relates to a thermal transfer sheet and printed matter. More specifically, the invention relates to a thermal transfer sheet capable of suppressing the occurrence of static electricity during transfer onto a material as a transfer image support, and printed matter excellent in antistatic properties.

It has been done to form a gradation image, or a monotone image, such as a character or sign, on a substrate by a thermal transfer process. As the thermal transfer process, sublimation transfer and fusion transfer are used widely.

Of these methods, the sublimation transfer method comprises using a thermal transfer sheet which has, carried on a base sheet, a dye layer containing a sublimation dye as a coloring material fused or dispersed in a binder resin; superimposing this thermal transfer sheet on a substrate; and applying energy corresponding to image information to a heating device, such as a thermal head, to migrate the sublimation dye contained in the dye layer on the thermal transfer sheet to the substrate, thereby forming an image. This sublimation transfer method can control the amount of migration of the dye on a dot basis depending on the amount of the energy applied to the thermal transfer sheet, and is thus excellent in the formation of a gradation image.

Many cards, including identification card, driver's license, and membership card, have been used. These cards have records of various pieces of information which specify the status of the owner, etc. For ID cards, in particular, an image of a photograph of the face is the most important information in addition to character information such as the address and name. Recording of information in such cards is made by the use of the above-described sublimation transfer method which facilitates the formation of various images, characters and signs.

However, a gradation image or a monotone image formed by the sublimation transfer method may undergo fading, because the transferred dye is present on the surface. To avoid this drawback, and prevent forgery or doctoring of image information, a protective layer is provided on the image formed.

As means of forming such a protective layer, there is a method involving the transfer of a protective layer onto a formed image by the use of a thermal transfer sheet provided with a transfer layer. Transfer of this protective layer is carried out using a thermal printer. However, this method has posed the problem that a large amount of static electricity develops during peeling of the protective layer from the thermal transfer sheet, thereby causing poor transport of a material as a transfer image support, or of a thermal transfer sheet, within the thermal printer.

To solve this problem, the customary practice has been to provide an antistatic layer on, or contain an antistatic agent in, the material as a transfer image support, thereby suppressing the occurrence of static electricity during transfer of the protective layer. However, even when the material as a transfer image support is provided with antistatic means, it is difficult to prevent static electricity generated during the peeling of the protective layer from the thermal transfer sheet. Furthermore, the transferred material after transfer of the protective layer has the most facial surface which is not the antistatic layer or the surface containing the antistatic agent. Thus, deposition of static electricity on the transferred material cannot be prevented effectively.

DISCLOSURE OF THE INVENTION

The present invention has been accomplished in light of the above circumstances, and aims to provide a thermal transfer sheet causing little static electricity during transfer onto a material as a transfer image support, and printed matter excellent in antistatic properties.

To attain this objective, the thermal transfer sheet of this invention is configured to have a protective transfer layer provided on at least part of one of the surfaces of a base sheet so as to be peelable, the protective transfer layer containing an antistatic agent.

The thermal transfer sheet of the invention is also configured to have a protective transfer layer provided on at least part of one of surfaces of a base sheet through a nontransferable release layer so as to be peelable, at least one of the release layer and the protective transfer layer containing an antistatic agent.

The thermal transfer sheet of the invention is also configured such that the protective transfer layer has a multilayer structure.

The thermal transfer sheet of the invention is also configured such that the protective transfer layer has an antistatic layer containing an antistatic agent.

The thermal transfer sheet of the invention is also configured such that the antistatic agent comprises at least one of a conductive resin, a conductive metal oxide, and a surface active agent, the particle size of the conductive metal oxide is in the range of 10 to 100 nm, the conductive metal oxide is zinc antimonate ($ZnO.Sb_2O_5$), or the surface active agent is a quaternary ammonium salt.

The thermal transfer sheet of the invention is also configured to have a dye layer having one or more colors on the base sheet, or is also configured such that the dye layer and the protective transfer layer are formed in a coplanar, alternate manner or side by side.

The printed matter of the invention is configured to comprise a substrate, an image formed on at least one of the surfaces of the substrate by a sublimation transfer process, and a protective transfer layer provided so as to cover at least part of the image, the protective transfer layer being a protective transfer layer formed by transfer using the above-described thermal transfer sheet.

According to the foregoing present invention, the protective transfer layer contains the antistatic agent, and if the release layer is provided, at least one of the release layer and the protective transfer layer contains the antistatic agent. Thus, the amount of static electricity generated during the peeling of the protective transfer layer is minimized. Furthermore, the protective transfer layer containing the antistatic agent, after its transfer onto a material as a transfer image support, imparts excellent antistatic properties to this material. Printed matter having such protective transfer layer formed on an image by transfer has excellent antistatic properties.

BEST MODE FOR CARRYING OUT THE INVENTION

Embodiments of the present invention will now be described with reference to the accompanying drawings.

Thermal Transfer Sheet

Figure 1:
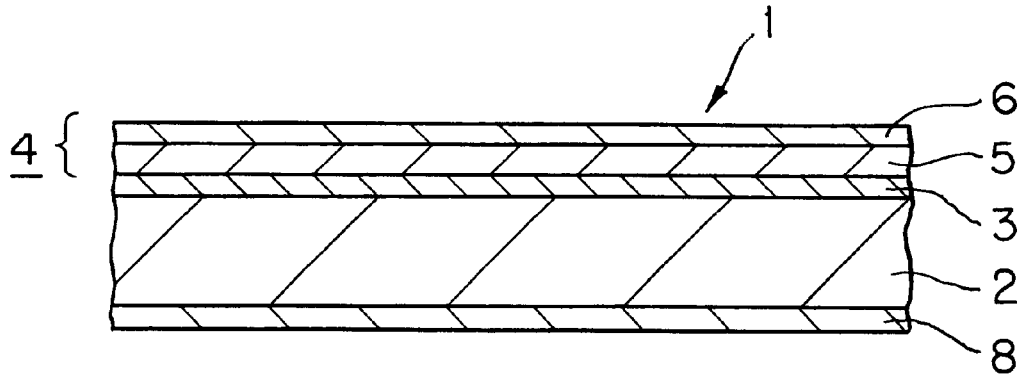
FIG. 1 is a schematic sectional view showing an embodiment of a thermal transfer sheet according to the present invention.

FIG. 1 is a schematic sectional view showing an embodiment of a thermal transfer sheet according to the present invention. In FIG. 1, a thermal transfer sheet 1 of the present invention has a protective transfer layer 4 in a peelable manner on one of the surfaces of a base sheet 2 via a nontransferable release layer 3, and has a back layer 8 on the other surface of the base sheet 2. The protective transfer layer 4 is composed of a protective layer 5 and an adhesive layer 6. The thermal transfer sheet 1 of the invention is characterized by containing an antistatic agent in at least one of the release layer 3 and the protective transfer layer 4.

The base sheet 2 constituting the thermal transfer sheet 1 of the invention may be a base sheet which is used in a conventional thermal transfer sheet. Preferred examples of the base sheet are thin papers such as glassine paper, condenser paper and paraffin paper, stretched or unstretched films of highly heat resistant polyester, polypropylene, polycarbonate, cellulose acetate or polyethylene derivatives, e.g., polyethylene terephthalate, polyethylene naphthalate, polybutylene terephthalate, polyphenylene sulfide, polyether ketone, and polyether sulfone, stretched or unstretched films of plastics such as polyvinyl chloride, polyvinylidene chloride, polystyrene, polyamide, polyimide, polymethylpentene, and ionomer, and laminates of these materials. The thickness of the base sheet 2 can be selected, as desired, depending on the material so that suitable strength and heat resistance will be obtained. Usually, its preferred thickness is about 1 to 100 $\mu$m.

The release layer 3 of the thermal transfer sheet 1 is nontransferable when the protective transfer layer 4 is transferred onto a material as a transfer image support. The release layer 3 can be formed by using a release agent such as wax, silicone wax, silicone resin, polyvinyl alcohol, fluorocarbon resin, or acrylic resin.

In containing an antistatic agent in the release layer 3, its content can be set, as desired, in consideration of the type of the antistatic agent used, the thickness of the release layer 3, and so forth. For example, its content can be set in the range of from 1 to 50% by weight. If the content of the antistatic agent is too low, a sufficient antistatic action is not exhibited during peeling of the protective transfer layer 4. If this content is too high, transparency required of the protective layer is decreased. This is not desirable.

Formation of the release layer 3 can be performed by dissolving or dispersing a mixture of the above release agent and necessary additives, such as an antistatic agent, in a suitable solvent to prepare an ink, applying the ink onto the base sheet 2 by publicly known means, and drying the coating. The thickness of the release layer 3 is preferably about 0.5 to 5 $\mu$m.

The antistatic agent used may be a publicly known antistatic agent, which can be used without any restriction. Examples of the antistatic agent used are conductive metals such as nickel, aluminum, cobalt, chromium, magnesium, molybdenum, palladium, rhodium, tin, tantalum, titanium, tungsten, indium, cadmium, ruthenium, zirconium, iron, lead, platinum, zinc, gold, silver and copper; conductive metal oxides such as oxides of these conductive metals, zinc antimonate ($ZnO.Sb_2O_5$), tin oxide ($SnO_2$), indium oxide ($InO_3$) and cadmium oxide (CdO); conductive resins such as stearate resin, methacrylate resin, ethoxylate resin, and acrylate resin; and surface active agents such as quaternary ammonium salts, carbonic acid salts, sulfonic acid salts, sulfuric acid esters, and phosphoric acid esters. The conductive metal oxide preferably has a particle size, determined by the dynamic light scattering method, of 10 to 100 nm. If the particle size is less than 10 nm, addition of a large amount is necessary for retaining conductivity. If the particle size is more than 100 nm, the surface of the protective layer after transfer may become rough, or transparency of the protective layer may be reduced. This is not desirable.

The protective layer 5 constituting the protective transfer layer 4 of the thermal transfer sheet 1 can be formed, for example, from synthetic resin, and a mixture of synthetic resin and wax.

Examples of the synthetic resin used for the protective layer 5 are cellulose resins such as ethyl cellulose, hydroxyethyl cellulose, hydroxypropyl cellulose, methyl cellulose, cellulose acetate, and cellulose acetobutyrate; and vinyl resins such as polyvinyl alcohol, polyvinyl acetate, polyvinyl butyral, polyvinyl acetal, polyvinyl pyrrolidone, and polyacrylamide.

Examples of the wax used for the protective layer 5 are microcrystalline wax, carnauba wax, paraffin wax, Fischer-Tropsch wax, various low molecular weight polyethylenes, Japan wax, beeswax, spermaceti, insect wax, wool wax, shellac wax, candelilla wax, petrolatum, partially modified wax, fatty acid ester, and fatty acid amide. The amount of the wax used is preferably in the range of 0.5 to 10 parts by weight per 100 parts by weight of the synthetic resin.

If the antistatic agent is contained in the protective transfer layer 4, the antistatic agent can be contained in one of or both of the protective layer 5 and the adhesive layer 6. The antistatic agent used may be a publicly known antistatic agent, which can be used without restriction. Its examples are a aforementioned antistatic agents.

The content of the antistatic agent in the protective layer 5 can be set, as desired, in consideration of the type of the antistatic agent used, the thickness of the protective layer 5, and so forth. For example, its content can be set in the range of from 1 to 50% by weight. If the content of the antistatic agent is too low, a sufficient antistatic action is not exhibited in the protective transfer layer 4. If this content is too high, transparency of the protective layer is decreased, or its durability reduced. This is not desirable.

The protective layer 5 may contain substantially transparent, inorganic or organic fine particles. By incorporating such fine particles in the protective layer 5, release of the protective transfer layer 4 when transferred is improved. Moreover, the fretting resistance of the protective layer 5 can be improved, and the surface gloss of the protective layer 5 is reduced, whereby a matte surface can be obtained. Examples of the fine particles are those with relatively high transparency, such as silica, Teflon powder, and nylon powder. The amount of the fine particles used is preferably 0.1 to 10% by weight based on the synthetic resin. If this amount exceeds 10% by weight, the transparency and durability of the protective layer 5 will be decreased.

By incorporating additives, such as an ultraviolet absorber, an antioxidant, and a fluorescent whitener, into the protective layer 5, the gloss, light resistance, weather resistance, and whiteness of the image, etc. covered with the protective transfer layer 4 after transfer can be improved.

A method for forming the protective layer 5 on the base sheet 2 comprises, for example, preparing an ink having additives, such as an antistatic agent and wax, added, if desired, to synthetic resin, coating this ink onto the release layer 3 already on the base sheet by publicly known means such as gravure coating, gravure reverse coating or roll coating, and drying the applied coating. The thickness of the protective layer 5 formed is about 0.5 to 5 μm, preferably about 1 to 2 μm.

The adhesive layer 6 constituting the protective transfer layer 4 of the thermal transfer sheet 1 acts to facilitate the transfer of the protective transfer layer 4 onto a material as a transfer image support. An adhesive forming the adhesive layer 6 may be a hot-melt adhesive such as acrylate resin, styrene acrylate resin, vinyl chloride resin, styrene-vinyl chloride-vinyl acetate copolymer, or vinyl chloride-vinyl acetate copolymer. Formation of the adhesive layer 6 can be performed by publicly known means such as gravure coating, gravure reverse coating or roll coating. The thickness of the adhesive layer is preferably about 0.1 to 5 μm.

If an antistatic agent is contained in the adhesive layer 6, the content of the antistatic agent can be set, as desired, in consideration of the type of the antistatic agent used, the thickness of the adhesive layer 6, and so forth. For example, its content can be set in the range of from 1 to 50% by weight. If the content of the antistatic agent is too low, a sufficient antistatic action is not exhibited in the protective transfer layer 4. If this content is too high, adhesiveness may be reduced. This is not desirable.

The adhesive layer 6 may further contain additives such as an antioxidant and a fluorescent whitener. If the aforementioned protective layer 5 has sufficient thermal adhesiveness, there is no need to provide the adhesive layer 6, and the protective transfer layer 4 may have a single-layered structure comprising the protective layer 5 alone.

The back layer 8 constituting the thermal transfer sheet 1 is provided to prevent thermal fusion between a heating device, such as a thermal head, and the base sheet 2, and smooth their travel. Examples of the resin used as the back layer 8 are cellulose resins such as ethyl cellulose, hydroxyethyl cellulose, hydroxypropyl cellulose, methyl cellulose, cellulose acetate, cellulose acetobutyrate, and nitrocellulose; vinyl resins such as polyvinyl alcohol, polyvinyl acetate, polyvinyl butyral, polyvinyl acetal, and polyvinyl pyrrolidone; acrylic resins such as polymethyl methacrylate, polyethyl acrylate, polyacrylamide, and acrylonitrile-styrene copolymer; and resins such as polyamide resin, polyvinyl toluene resin, coumarone-indene resin, polyester resin, polyurethane resin, and silicone-modified or fluorine-modified urethane resin. These natural or synthetic resins are used alone or as mixtures. To enhance the heat resistance of the back layer 8, it is preferred to use the resin having a reactive group, such as a hydroxyl group, and crosslink this resin by the concomitant use of a polyisocyanate as a crosslinking agent, thereby making the back layer 8 a crosslinked resin layer.

To impart to the back layer 8 the nature of sliding relative to a thermal head, it is permissible to add a solid or liquid release agent or a lubricant to the back layer 8, thereby giving it resistance to hot slide. Examples of the release agent or the lubricant are various waxes such as polyethylene wax and paraffin wax, higher aliphatic alcohols, organopolysiloxanes, anionic surfactants, cationic surfactants, amphoteric surfactants, nonionic surfactants, fluorine-based surfactants, organic carboxylic acids and their derivatives, fluorocarbon resins, silicone resins, and fine particles of inorganic compounds such as talc and silica. The amount of the release agent or lubricant contained in the back layer 8 is 5 to 50% by weight, preferably about 10 to 30% by weight.

The thickness of this back layer 8 can be set at about 0.1 to 10 μm, preferably about 0.5 to 5 μm.

When the base sheet 2 in the thermal transfer sheet 1 has moderate adhesiveness and peeling properties relative to the protective transfer layer 4, there is no need to provide the release layer 3. In this case, the protective transfer layer 4 must contain an antistatic agent.

Figure 2:
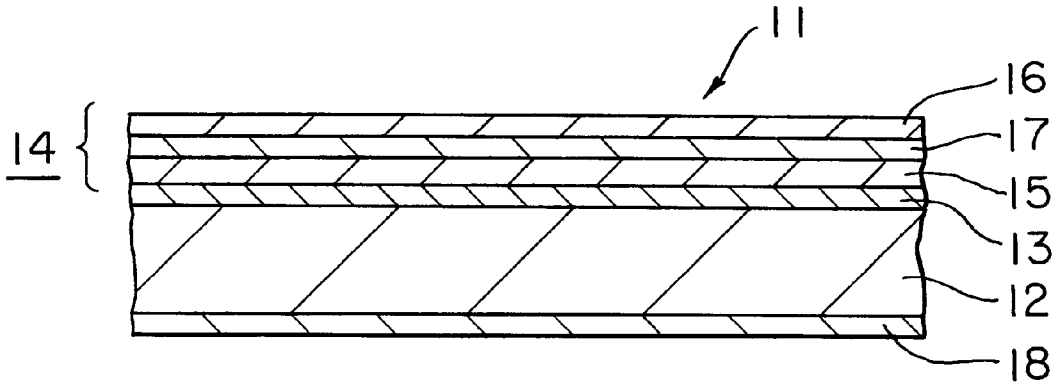
FIG. 2 is a schematic sectional view showing another embodiment of the thermal transfer sheet of the invention.

FIG. 2 is a schematic sectional view showing another embodiment of the thermal transfer sheet of the invention. In FIG. 2, a thermal transfer sheet 11 of the present invention has a protective transfer layer 14 in a peelable manner on one of the surfaces of a base sheet 12 via a release layer 13, and has a back layer 18 on the other surface of the base sheet 12. The protective transfer layer 14 is a laminate consisting of a protective layer 15, an antistatic layer 17, and an adhesive layer 16 stacked on the release layer 13 in this order. The thermal transfer sheet 1 of the invention contains an antistatic agent in the antistatic layer 17 constituting the protective transfer layer 14, and may also contain an antistatic agent in the release layer 13.

The base sheet 12 constituting the thermal transfer sheet 11 may be the same as the aforementioned base sheet 2, and an explanation for it is omitted herein.

The release layer 13 constituting the thermal transfer sheet 11 may contain an antistatic agent as described above. Regardless of whether the release layer 13 contains or does not contain an antistatic agent, it may be the same as the release layer 3 of the aforementioned thermal transfer sheet 1.

The protective layer 15 constituting the protective transfer layer 14 of the thermal transfer sheet 11 can be the same as the protective layer 5 of the aforementioned thermal transfer sheet 1, provided that no antistatic agent is contained therein.

The antistatic layer 17 constituting the protective transfer layer 14 of the thermal transfer sheet 11 contains an antistatic agent in a binder. The antistatic agent used may be a publicly known antistatic agent, which can be used without restriction. Its examples are the aforementioned antistatic agents. As the binder, the synthetic resin exemplified for use in the aforementioned protective layer 5 can be used. Formation of such antistatic layer 17 can be performed by publicly known means such as gravure coating, gravure reverse coating or roll coating. The thickness of the antistatic layer 17 is preferably about 0.1 to 5 μm.

The content of the antistatic agent in the antistatic layer 17 can be set, as desired, in consideration of the type of the antistatic agent used, the thickness of the antistatic layer 17, and so forth. For example, its content can be set in the range of from 1 to 50% by weight. If the content of the antistatic agent is too low, a sufficient antistatic action is not exhibited in the protective transfer layer 14. If this content is too high, it may cause a decrease in transparency. This is not desirable.

The adhesive layer 16 constituting the protective transfer layer 14 of the thermal transfer sheet 11 may be the same as the adhesive layer 6 of the aforementioned thermal transfer sheet 1.

If the base sheet 12 in the thermal transfer sheet 11 has moderate adhesiveness and peeling properties relative to the protective transfer layer 14, there is no need to provide the release layer 13.

Figure 3:
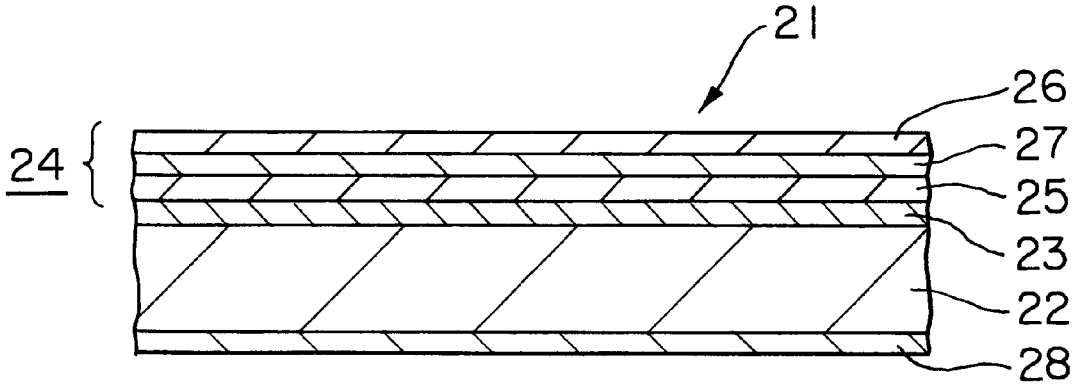
FIG. 3 is a schematic sectional view showing still another embodiment of the thermal transfer sheet of the invention.

FIG. 3 is a schematic sectional view showing still another embodiment of the thermal transfer sheet of the present invention. In FIG. 3, a thermal transfer sheet 21 of the invention has a protective transfer layer 24 in a peelable manner on one of the surfaces of a base sheet 22 via a release layer 23, and has a back layer 28 on the other surface of the base sheet 22. The protective transfer layer 24 is a laminate consisting of a protective layer 25, an ultraviolet absorber layer 27, and an adhesive layer 26 stacked on the release layer 23 in this order. The thermal transfer sheet 21 of the invention contains an antistatic agent in at least one of the potective transfer layer 24 and the release layer 23.

The base sheet 22 constituting the thermal transfer sheet 21 may be the same as the aforementioned base sheet 2, and an explanation for it is omitted herein.

The release layer 23 constituting the thermal transfer sheet 21 may contain an antistatic agent as described above. Regardless of whether the release layer 23 contains or does not contain an antistatic agent, it may be the same as the release layer 3 of the aforementioned thermal transfer sheet 1.

If the base sheet 22 has moderate adhesiveness and peeling properties relative to the protective transfer layer 24, there is no need to provide the release layer 23. In this case, the protective transfer layer 24 must contain an antistatic agent.

When an antistatic agent is to be incorporated into the protective transfer layer 24 of the thermal transfer sheet 21, the antistatic agent may be contained in one of the protective layer 25, the ultraviolet absorber layer 27, and the adhesive layer 26. Regardless of whether the protective layer 25 contains or does not contain an antistatic agent, it may be the same as the protective layer 5 of the aforementioned thermal transfer sheet 1.

The ultraviolet absorber layer 27 constituting the protective transfer layer 24 of the thermal transfer sheet 21 is a layer for improving the light resistance of the protective transfer layer 24. This ultraviolet absorber layer 27 is characterized by containing a resin to which a reactive ultraviolet absorber has been bonded by reaction. Examples of the reactive ultraviolet absorber are those in which an addition polymerizable double bond such as a vinyl group, an acryloyl group or a methacryloyl group, or an alcoholic hydroxyl group, an amino group, a carboxyl group, an epoxy group, or an isocyanate group has been introduced into an unreactive ultraviolet absorber derived from salicylate, benzophenone, benzotriazole, substituted acrylonitrile, nickel chelate, or hindered amine that is a publicly known organic ultraviolet absorber.

Fixing of the above reactive ultraviolet absorber to the resin by reaction can be performed in various manners. For instance, a resin component such as a publicly known monomer, oligomer or reactive polymer is radical polymerized with the reactive ultraviolet absorber having the above-mentioned addition polymerizable double bond, whereby a copolymer can be prepared.

If the reactive ultraviolet absorber has an amino group, a carboxyl group, an epoxy group, or an isocyanate group, a thermoplastic resin having a group reactive with this reactive group is used. The reactive ultraviolet absorber can be reacted with and fixed to the thermoplastic resin by heat or the like by the use of a catalyst, if desired.

Examples of the monomer component to be copolymerized with the reactive ultraviolet absorber are methyl (meth) acrylate, ethyl (meth)acrylate, propyl (meth)acrylate, butyl (meth)acrylate, isobutyl (meth)acrylate, t-butyl (meth) acrylate, isodecyl (meth)acrylate, lauryl (meth)acrylate, lauryltridecyl (meth)acrylate, tridecyl (meth)acrylate, ceryl-stearyl (meth)acrylate, stearyl (meth)acrylate, ethylhexyl (meth)acrylate, octyl (meth)acrylate, cyclohexyl (meth) acrylate, benzyl (meth)acrylate, methacrylic acid, hydroxyethyl (meth)acrylate, hydroxypropyl (meth)acrylate, dimethylaminoethyl (meth)acrylate, diethylaminoethyl (meth) acrylate, t-butylaminoethyl (meth)acrylate, glycidyl (meth) acrylate, tetrahydrofurfuryl (meth)acrylate, ethylene di(meth)acrylate, diethylene glycol (meth)acrylate, triethylene glycol di(meth)acrylate, tetraethylene glycol di(meth) acrylate, decaethylene glycol (meth)acrylate, pentadecaethylene (meth)acrylate, pentacontahectaethylene glycol (meth)acrylate, butylene di(meth)acrylate, allyl (meth) acrylate, trimethylolpropane tri(meth)acrylate, hexanediol di(meth)acrylate, tripropylene glycol di(meth)acrylate, pentaerythritol tetra(meth)acrylate, pentaerythritol hexa(meth) acrylate, dipentaerythritol hexa(meth)acrylate, 1,6-hexanediol di(meth)acrylate, neopentyl glycol penta(meth) acrylate, and phosphagen hexa(meth)acrylate.

The above-enumerated substances may be used not only as monomers, but also as oligomers. In addition, acrylate reactive polymers of the polyester acrylate or epoxyacrylate type, comprising polymers of the above substances or their derivatives, can also be used. These monomers, oligomers or acrylate type reactive polymers may be used alone or as a mixture.

The above-mentioned thermoplastic resinous monomer, oligomer or acrylate type reactive polymer is copolymerized with the reactive ultraviolet absorber to obtain a thermoplastic copolymer resin having the reactive ultraviolet absorber fixed thereto. From this copolymer resin, the ultraviolet absorber layer 27 is formed.

In the copolymer resin, the reactive ultraviolet absorber is contained in a proportion of 10 to 90% by weight, preferably 30 to 70% by weight. If its content is less than 10% by weight, satisfactory light resistance attributed to the ultraviolet absorber layer 27 is not obtained. If its content is more than 90% by weight, a problem arises, such as tackiness during the formation of the ultraviolet absorber layer 27 by coating, or bleeding of a dye image formed on the material as a transfer image support.

The molecular weight of the copolymer resin is about 5,000 to 250,000, preferably about 9,000 to 30,000. If the molecular weight is less than 5,000, the film strength of the ultraviolet absorber layer 27 is insufficient. If it exceeds 250,000, the release of the ultraviolet absorber layer 27 during transfer becomes poor.

The ultraviolet absorber layer 27 may be formed from the copolymer resin in combination with a publicly known organic ultraviolet absorber of the benzophenone, benzotriazole, salicylic ester or hindered amine type, and an inorganic ultraviolet absorber such as titanium oxide, zinc oxide or cerium oxide.

Formation of the ultraviolet absorber layer 27 can be performed by publicly known means such as gravure coating, gravure reverse coating or roll coating. The thickness of the ultraviolet absorber layer 27 formed is about 0.1 to 10 $\mu$m, preferably about 0.5 to 3 $\mu$m.

If an antistatic agent is incorporated into the ultraviolet absorber layer 27, the content of the antistatic agent can be set, as desired, in consideration of the type of the antistatic agent used, the thickness of the ultraviolet absorber layer 27, and so forth. For example, its content can be set in the range of from 1 to 50% by weight. If the content of the antistatic agent is too low, a sufficient antistatic action is not exhibited in the protective transfer layer 24. If this content is too high, it may cause a decrease in transparency required of the protective layer. This is not desirable.

The adhesive layer 26 constituting the protective transfer layer 24 of the thermal transfer sheet 21, regardless of whether it contains or does not contain an antistatic agent, may be the same as the adhesive layer 6 of the aforementioned thermal transfer sheet 1.

Figure 4:
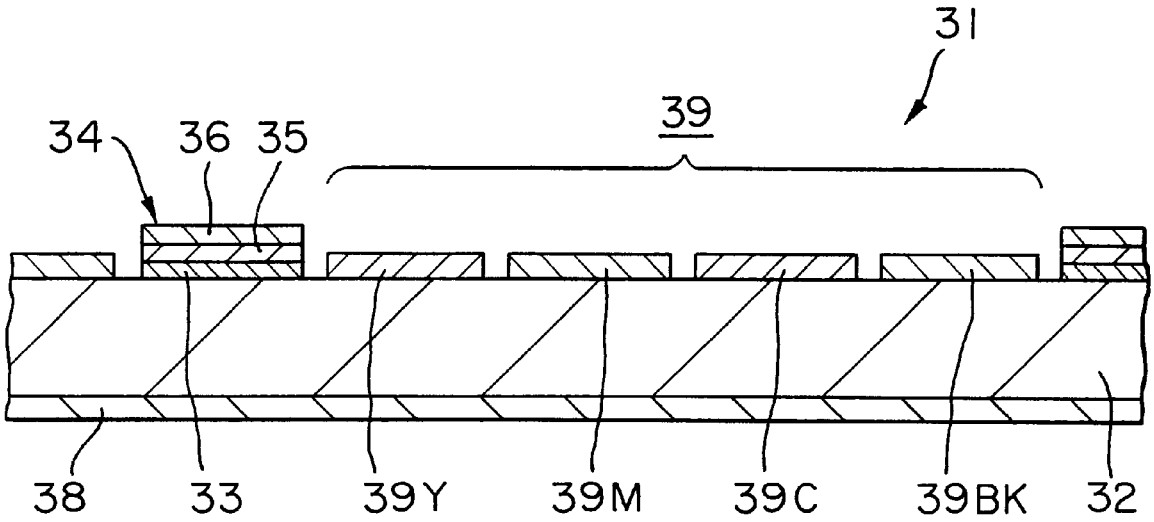
FIG. 4 is a schematic sectional view showing a further embodiment of the thermal transfer sheet of the invention.

FIG. 4 is a schematic sectional view showing a further embodiment of the thermal transfer sheet of the present invention. In FIG. 4, a thermal transfer sheet 31 is a composite type thermal transfer sheet comprising a protective transfer layer 34 provided in a peelable manner on one of the surfaces of a base sheet 32 via a release layer 33; a dye layer 39 formed in a coplanar, alternate manner relative to a laminate of the release layer 33 and the protective transfer layer 34, and a back layer 38 on the other surface of the base sheet 32. The protective transfer layer 34, in the illustrated embodiment, comprises a protective layer 35, and an adhesive layer 36. An antistatic agent is contained in at least one of the protective transfer layer 34 and the release layer 33.

The base sheet 32 constituting the thermal transfer sheet 31 may be the same as the aforementioned base sheet 2, and an explanation for it is omitted herein.

The release layer 33 constituting the thermal transfer sheet 31 may contain an antistatic agent as described above. Regardless of whether the release layer 33 contains or does not contain an antistatic agent, it may be the same as the release layer 3 of the aforementioned thermal transfer sheet 1.

When an antistatic agent is to be incorporated into the protective transfer layer 34 consisting of the protective layer 35 and the adhesive layer 36, the antistatic agent may be contained in one of or both of the protective layer 35 and the adhesive layer 36.

The protective layer 35, regardless of whether it contains or does not contain an antistatic agent, may be the same as the protective layer 5 of the aforementioned thermal transfer sheet 1. The adhesive layer 36 constituting the protective transfer layer 34, regardless of whether it contains or does not contain an antistatic agent, may be the same as the adhesive layer 6 of the aforementioned thermal transfer sheet 1.

The dye layer 39 comprises dye layers 39Y, 39M, 39C and 39BK of different colors, i.e., yellow, magenta, cyan, and black. This dye layer 39 (39Y, 39M, 39C and 39BK) contains at least sublimation dyes and a binder resin.

The sublimation dyes used may be publicly known sublimation dyes for use in thermal transfer sheets employed in the sublimation transfer process. There are no restrictions on the sublimation dyes. Their examples are yellow dyes such as Phorone Brilliant Yellow 6GL, PTY-52 and Macrolex Yellow 6G, red dyes such as MS Red G, Macrolex Red Violet R, Celes Red 7B, Samaron Red HBSL, and SK Rubin SEGL, and blue dyes such as Kayaset Blue 714, Waxoline Blue AP-FW, Phorone Brilliant Blue S-R, MS Blue 100, and Daito Blue No. 1. By combining these sublimation dyes of different colors, a dye layer of an arbitrary color such as black can be formed.

As the binder resin which carries the dye in the dye layer 39, a publicly known resin can be used. Its examples are cellulose resins such as ethyl cellulose, hydroxyethyl cellulose, hydroxypropyl cellulose, methyl cellulose, cellulose acetate, and cellulose acetobutyrate; vinyl resins such as polyvinyl alcohol, polyvinyl acetate, polyvinyl butyral, polyvinyl acetal, polyvinyl pyrrolidone, and polyacrylamide, and polyesters. Of these resins, the cellulose, acetal, butyral and polyester resins are preferred because of heat resistance and the migration of the dye.

The dye layer 39 is formed by dissolving or dispersing a mixture of the above sublimation dye, binder resin, and necessary additives in a suitable solvent to prepare an ink, applying the ink onto the base sheet by publicly known means, and drying the coating. The thickness of the dye layer 39 is 0.2 to 5 $\mu$m, preferably about 0.4 to 2 $\mu$m. The proportion of the sublimation dye in the dye layer 39 is 5 to 90% by weight, preferably 10 to 70% by weight.

In the above-described thermal transfer sheet 31, the protective transfer layer 34, 39Y, 39M, 39C and 39BK are arranged in this order, but their arrangement is not restricted to this order. Nor does the black dye layer 39BK need to be present. Furthermore, part or all of the dye layer 39 (39Y, 39M, 39C, 39BK) may be two-layered in structure.

In the illustrated embodiment, the protective transfer layer 34 comprises two layers, i.e., the protective layer 35 and the adhesive layer 36. Alternatively, the protective transfer layer 34 may be one without the adhesive layer, a three-layered one comprising a protective layer, an antistatic layer and an adhesive layer as shown in FIG. 2, or a three-layered one comprising a protective layer, an ultraviolet absorber layer and an adhesive layer as shown in FIG. 3.

The thermal transfer sheet of the present invention is not restricted to the foregoing embodiments, but may be constituted arbitrarily according to the purpose of use, etc. If constituted as a composite type, in particular, the thermal transfer sheet permits the simultaneous execution of image formation by a thermal transfer process, and transfer of the protective transfer layer to the material as a transfer image support.

Printed Matter

Next, the printed matter of the present invention will be described.

Figure 5:
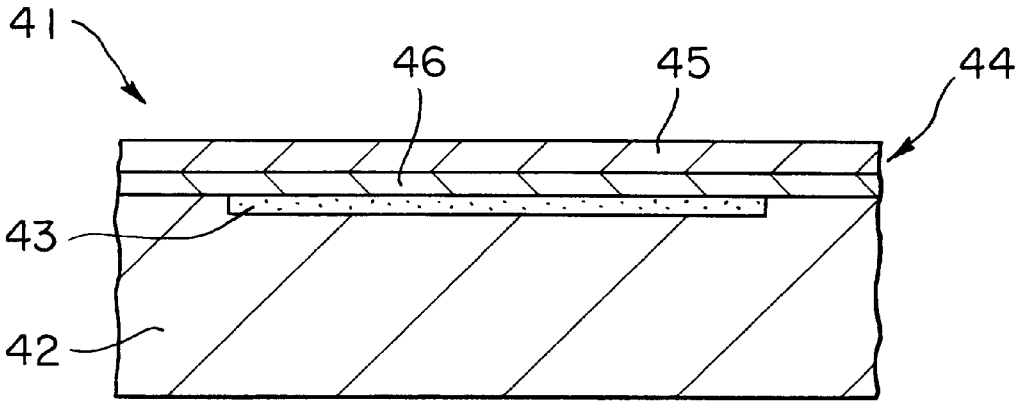
FIG. 5 is a schematic sectional view showing an embodiment of printed matter according to the present invention.

FIG. 5 is a schematic sectional view showing an embodiment of printed matter according to the present invention. In FIG. 5, printed matter 41 of the present invention comprises a substrate 42, an image 43 formed on at least one of the surfaces of the substrate 42 by a sublimation transfer process, and a protective transfer layer 44 provided so as to cover the image 43. In the illustrated embodiment, the whole of the image 43 is covered with the protective transfer layer 44, which has a two-layer structure comprising an adhesive layer 46 and a protective layer 45 stacked in this order on the substrate 42. This two-layered protective transfer layer 44 is formed by transferring the protective transfer layer 4 of the aforementioned thermal transfer sheet 1 of the present invention so as to cover the image 43. Thus, the amount of static electricity generated during peeling of the protective transfer layer 4 for formation of the protective transfer layer 44 is effectively reduced by the antistatic agent contained in the protective transfer layer 4 and/or the release layer 3. If the protective transfer layer 44 transferred contains an antistatic agent, moreover, excellent antistatic properties are imparted to the printed matter 41.

The protective layer 45 and the adhesive layer 46 constituting the protective transfer layer 44 correspond, respectively, to the protective layer and the adhesive layer constituting the protective transfer layer of the thermal transfer sheet of the present invention. Thus, their explanations are omitted herein.

In the illustrated embodiment, the protective transfer layer 44 comprises two layers, i.e., the protective layer 45 and the adhesive layer 46. However, it may be one without the adhesive layer, a three-layered one comprising a protective layer, an antistatic layer and an adhesive layer, or a three-layered one comprising a protective layer, an ultraviolet absorber layer and an adhesive layer.

Formation of the image 43 on the substrate 42 can be carried out by using a publicly known thermal transfer sheet following a thermal transfer process, or the thermal transfer sheet of the composite type of the present invention which has the protective transfer layer and the dye layer.

The substrate 42 constituting the above-described printed matter of the invention may be any substrate, as long as its surface bearing an image recorded by a thermal transfer process, such as a full-color image, has dyeability with a dye. Alternatively, the substrate 42 may be a substrate lacking dyeability with a dye and provided with an acceptance layer, or a substrate lacking dyeability with a dye and provided with an acceptance layer via a primer layer (a layer for facilitating adhesion). Also, the substrate 42 may have a back layer suitable for an intended use.

The printed matter of the present invention is not restricted to the foregoing aspects. For example, if the printed matter has an image on the other surface of the substrate 42, this image may be covered with the protective transfer layer 44. The printed matter of the invention may be in any form, such as a card, a photograph or a postcard.

The present invention will be described in more detail by way of the following Examples.

Preparation of Thermal Transfer Sheet

EXAMPLE 1

One surface of a 6 $\mu$m thick polyethylene terephthalate film (Lumirror, TORAY INDUSTRIES, INC.) was coated with silicone resin by gravure coating to form a back layer (thickness 1 $\mu$m).

Then, the surface opposite to the surface on which the back layer was formed was coated with a nontransferable release layer composition A of the following formulation (coating amount: 0.5 g/m$^2$ (on a dry basis)) by gravure coating, followed by drying, to form a release layer containing zinc antimonate, an antistatic agent:

Nontransferable release layer composition A

| | |
|---|---|
| Colioidal silica (Snowtex 50, Nissan Chemical Industries, Ltd.) | 1.5 parts by weight |
| Polyvinyl alcohol | 4.0 parts by weight |
| Deionized water | 3.0 parts by weight |
| Denatured ethanol | 10 parts by weight |
| Zinc antimonate (Cellnax, Nissan Chemical Industries, Ltd.) | 18.5 parts by weight |

Then, a protective layer composition I of the following formulation was coated on the release layer (coating amount: 2 g/m$^2$ (on a dry basis)) by gravure coating, followed by drying, to form a protective layer:

Protective layer composition I

| | |
|---|---|
| Acrylic resin | 15 parts by weight |
| Vinyl chloride-vinyl acetate Copolymer | 5 parts by weight |
| Polyethylene wax | 0.3 parts by weight |
| Polyester resin | 0.1 parts by weight |
| Methyl ethyl ketone | 48 parts by weight |
| Toluene | 48 parts by weight |

Then, an ultraviolet absorber layer composition of the following formulation was coated on the protective layer (coating amount: 2 g/m$^2$ (on a dry basis)) by gravure coating, followed by drying, to form an ultraviolet absorber layer:

Ultraviolet absorber layer composition

Copolymer resin having a reactive ultraviolet absorber bonded thereto by reaction

| | |
|---|---|
| (UVA-635L, BASF Japan) | 40 parts by weight |
| Methyl ethyl ketone | 30 parts by weight |
| Toluene | 30 parts by weight |

Further, an adhesive layer composition of the following formulation was coated on the ultraviolet absorber layer (coating amount: 2 g/m$^2$ (on a dry basis)) by gravure coating, followed by drying, to form an adhesive layer:

Adhesive layer composition

| | |
|---|---|
| Vinyl chloride-vinyl acetate Copolymer | 20 parts by weight |
| Methyl ethyl ketone | 100 parts by weight |
| Toluene | 100 parts by weight |

In the foregoing manner, there was prepared a thermal transfer sheet of a layered structure as shown in FIG. 3 in which a protective transfer layer (containing no antistatic agent) as a laminate of the protective layer, the ultraviolet absorber layer and the adhesive layer was provided in a peelable manner on the nontransferable release layer (containing an antistatic agent).

EXAMPLE 2

A thermal transfer sheet was prepared in the same manner as in Example 1, except that a nontransferable release layer composition B of the following formulation with an increased zinc antimonate content was used as the nontransferable release layer composition:

Nontransferable release layer composition B

| | |
|---|---|
| Colloidal silica (Snowtex 50, Nissan Chemical Industries, Ltd.) | 1.5 parts by weight |
| Polyvinyl alcohol | 4.0 parts by weight |
| Deionized water | 3.0 parts by weight |
| Denatured ethanol | 10 parts by weight |
| Zinc antimonate (Cellnax, Nissan Chemical Industries, Ltd.) | 37.0 parts by weight |

The resulting thermal transfer sheet had a layered structure as shown in FIG. 3 in which a protective transfer layer (containing no antistatic agent) as a laminate of a protective layer, an ultraviolet absorber layer and an adhesive layer was provided in a peelable manner on a nontransferable release layer (containing an antistatic agent).

EXAMPLE 3

In the same way as in Example 1, a back layer was formed on one of the surfaces of a polyethylene terephthalate film, and a nontransferable release layer was formed on the other surface thereof.

Then, a protective layer composition II of the following formulation was coated on the release layer (coating amount: 2 g/m$^2$ (on a dry basis)) by gravure coating, followed by drying, to form a protective layer containing zinc antimonate as an antistatic agent:

Protective layer composition II

| | |
|---|---|
| Acrylic resin | 15 parts by weight |
| Vinyl chloride-vinyl acetate Copolymer | 5 parts by weight |
| Copolymer resin having a reactive ultraviolet absorber bonded thereto by reaction (UVA-635L, BASF Japan) | 40 parts by weight |
| Polyethylene wax | 0.3 parts by weight |
| Polyester resin | 0.1 parts by weight |
| Methyl ethyl ketone | 40 parts by weight |
| Toluene | 40 parts by weight |
| Zinc antimonate (Cellnax, Nissan Chemical Industries, Ltd.) | 20 parts by weight |

Then, an adhesive layer was formed on this protective layer in the same way as in Example 1. Thus, there was prepared a thermal transfer sheet of a layered structure as shown in FIG. 1 in which a protective transfer layer (containing an antistatic agent) as a laminate of the protective layer and the adhesive layer was provided in a peelable manner on the nontransferable release layer (containing an antistatic agent).

EXAMPLE 4

A thermal transfer sheet was prepared in the same manner as in Example 1, except that a nontransferable release layer composition C of the following formulation containing no antistatic agent was used as the nontransferable release layer composition, and that a protective layer composition III of the following formulation containing an antistatic agent (quaternary ammonium salt) was used as the protective layer composition:

Nontransferable release layer composition C

| | |
|---|---|
| Colloidal silica (Snowtex 50, Nissan Chemical Industries, Ltd.) | 1.5 parts by weight |
| Polyyinyl alcohol | 4.0 parts by weight |
| Deionized water | 3.0 parts by weight |
| Denatured ethanol | 10 parts by weight |

Protective layer composition III

| | |
|---|---|
| Acrylic resin | 15 parts by weight |
| Vinyl chloride-vinyl acetate Copolymer | 5 parts by weight |
| Polyethylene wax | 0.3 parts by weight |
| Polyester resin | 0.1 parts by weight |
| Methyl ethyl ketone | 40 parts by weight |
| Toluene | 40 parts by weight |
| Quaternary ammonium salt (KS-555, Kao Corp.) | 20 parts by weight |

The resulting thermal transfer sheet had a layered structure as shown in FIG. 3 in which a protective transfer layer (containing an antistatic agent) as a laminate of a protective layer, an ultraviolet absorber layer and an adhesive layer was provided in a peelable manner on a nontransferable release layer (containing no antistatic agent).

EXAMPLE 5

In the same manner as in Example 1, a back layer was formed on one surface of a polyethylene terephthalate film.

Then, a release layer was formed in the same manner as in Example 1, provided that a nontransferable release layer composition D of the following formulation containing an antistatic agent (quaternary ammonium salt) was used as the nontransferable release layer composition:

Nontransferable release layer composition D

| | |
|---|---|
| Colloidal silica (Snowtex 50, Nissan Chemical Industries, Ltd.) | 1.5 parts by weight |
| Polyvinyl alcohol | 4.0 parts by weight |
| Deionized water | 3.0 parts by weight |
| Denatured ethanol | 10 parts by weight |
| Quaternary ammonium salt (KS-555, Kao Corp.) | 20 parts by weight |

Then, a protective layer composition IV of the following formulation was coated on the release layer (coating amount: 2 g/m$^2$ (on a dry basis)) by gravure coating, followed by drying, to form a protective layer containing an antistatic agent (quaternary ammonium salt):

Protective layer composition IV

| | |
|---|---|
| Acrylic resin | 15 parts by weight |
| Vinyl chloride-vinyl acetate Copolymer | 5 parts by weight |
| Copolymer resin having a reactive ultraviolet absorber bonded thereto by reaction (UVA-635L, BASF Japan) | 40 parts by weight |
| Polyethylene wax | 0.3 parts by weight |
| Polyester resin | 0.1 parts by weight |
| Methyl ethyl ketone | 40 parts by weight |
| Toluene | 40 parts by weight |
| Quaternary ammonium salt (KS-555, Kao Corp.) | 70 parts by weight |

Then, an adhesive layer was formed on the protective layer in the same manner as in Example 1.

In the foregoing manner, there was prepared a thermal transfer sheet of a layered structure as shown in FIG. 1 in which a protective transfer layer (containing an antistatic agent) as a laminate of the protective layer and the adhesive layer was provided in a peelable manner on the nontransferable release layer (containing an antistatic agent).

EXAMPLE 6

A thermal transfer sheet was prepared in the same manner as in Example 4, except that a protective layer composition V of the following formulation containing an antistatic agent (quaternary ammonium salt) was used as the protective layer composition:

Protective layer composition V

| | |
|---|---|
| Acrylic resin | 15 parts by weight |
| Vinyl chloride-vinyl acetate Copolymer | 5 parts by weight |
| Polyethylene wax | 0.3 parts by weight |
| Polyester resin | 0.1 parts by weight |
| Methyl ethyl ketone | 40 parts by weight |
| Toluene | 40 parts by weight |
| Quaternary ammonium salt (IAS-LC, CHHER CHEMICALS) | 50 parts by weight |

The resulting thermal transfer sheet had a layered structure as shown in FIG. 3 in which a protective transfer layer (containing an antistatic agent) as a laminate of a protective layer, an ultraviolet absorber layer and an adhesive layer was provided in a peelable manner on a nontransferable release layer (containing no antistatic agent).

EXAMPLE 7

In the same manner as in Example 1, a back layer was formed on one surface of a polyethylene terephthalate film.

Then, a release layer was formed in the same manner as in Example 1, provided that a nontransferable release layer composition E of the following formulation containing an antistatic agent (quaternary ammonium salt) was used as the nontransferable release layer composition:

Nontransferable release layer composition E

| | |
|---|---|
| Colloidal silica (Snowtex 50, Nissan Chemical Industries, Ltd.) | 1.5 parts by weight |
| Polyvinyl alcohol | 4.0 parts by weight |
| Deionized water | 3.0 parts by weight |
| Denatured ethanol | 10 parts by weight |
| Quaternary ammonium salt (M2-100, NOF CORP.) | 20 parts by weight |

Then, a protective layer composition VI of the following formulation was coated on the release layer (coating amount: 2 g/m$^2$ (on a dry basis)) by gravure coating, followed by drying, to form a protective layer containing an antistatic agent (quaternary ammonium salt):

Protective layer composition VI

| | |
|---|---|
| Acrylic resin | 20 parts by weight |
| Vinyl chloride-vinyl acetate Copolymer | 5 parts by weight |
| Copolymer resin having a reactive ultraviolet absorber bonded thereto by reaction (UVA-635L, BASF Japan) | 40 parts by weight |
| Polyethylene wax | 0.3 parts by weight |
| Polyester resin | 0.1 parts by weight |
| Methyl ethyl ketone | 40 parts by weight |
| Toluene | 40 parts by weight |
| Quaternary ammonium salt (M2-100, NOF CORP.) | 20 parts by weight |

Then, an adhesive layer was formed on the protective layer in the same manner as in Example 1. In this way, there was prepared a thermal transfer sheet of a layered structure as shown in FIG. 1 in which a protective transfer layer (containing an antistatic agent) as a laminate of the protective layer and the adhesive layer was provided in a peelable manner on the nontransferable release layer (containing an antistatic agent).

COMPARATIVE EXAMPLE

In the same manner as in Example 1, a back layer was formed on one surface of a polyethylene terephthalate film.

Then, a release layer was formed in the same manner as in Example 6, provided that the nontransferable release layer composition D (containing no antistatic agent) of Example 6 was used as the nontransferable release layer composition.

Then, a protective layer, an ultraviolet absorber layer, and an adhesive layer were formed on the release layer in the same way as in Example 1.

The resulting thermal transfer sheet had a layered structure in which a protective transfer layer (containing no antistatic agent) as a laminate of the protective layer, the ultraviolet absorber layer, and the adhesive layer was provided in a peelable manner on the nontransferable release layer (containing no antistatic agent).

The values of the surface electrical resistance of the thermal transfer sheets (Examples 1 to 7 and Comparative Example) prepared in the above-described manner were measured by the use of a surface electrical conductivity measuring device of Mitsubishi Petrochemical Co., Ltd. The results are shown in Table 1.

Image Formation

On the surface opposite to that surface of a polyethylene terephthalate film on which a back layer was formed in the above-described manner, inks of the following formulations for dye layers were coated by gravure coating in a coplanar manner in the order of yellow, magenta and cyan over a width of 15 cm (a length in the flowing direction of the base sheet). Then, the coatings were dried to prepare a thermal transfer sheet of the sublimation transfer type having a set of three colors.

Yellow coating solution

| | |
|---|---|
| Yellow disperse dye | 5.5 parts by weight |
| Quinophthalone dye of the following general formula in methyl ethyl ketone/toluene (weight ratio 1/1) | 90 parts by weight |

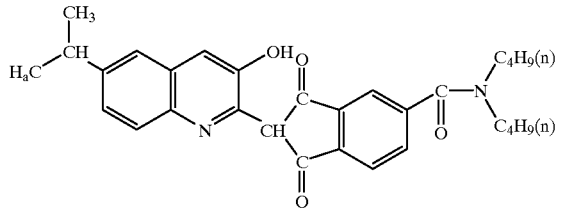

Magenta coating solution

The same as the above yellow coating solution, except that a magenta disperse dye (C.I. Disperse Red 60) was used as the disperse dye.

Cyan coating solution

The same as the above yellow coating solution, except that a cyan disperse dye (C.I. Solvent Blue 63) was used as the disperse dye.

Then, a center core (thickness 0.2 $\mu$m) of the following formulation for a card substrate was prepared:

Formulation of center core

| | |
|---|---|
| Polyvinyl chloride (degree of polymerization 800) | 100 parts by weight |
| White pigment (titanium oxide) | 10 parts by weight |

Then, prior to a treatment for facilitation of adhesion for a 100 $\mu$m thick white PET film (Lumirror, TORAY INDUSTRIES, INC.), an acceptance layer coating solution of the following formulation was coated (coating amount: 4.0 g/m$^2$ (on a dry basis)) to form an acceptance layer. On the back of the white PET film, a back layer coating solution of the following formulation was coated (coating amount: 1.5 g/m$^2$ (on a dry basis)) to prepare a substrate (a thermal transfer image receiving sheet).

| Acceptance layer coating solution | |
|---|---|
| Vinyl chloride-vinyl acetate copolymer (#1000A, DENKI KAGAKU KOGYO K.K.) | 19.6 parts by weight |
| Silicone (X62-1212, Shin-Etsu Chemical Co., Ltd.) | 2.0 parts by weight |

-continued

| | |
|---|---|
| Catalyst (CAT-PL-50T, Shin-Etsu Chemical Co., Ltd.) | 0.2 parts by weight |
| Methyl ethyl ketone | 39.1 parts by weight |
| Toluene | 39.1 parts by weight |
| Back layer coating solution | |
| Acrylic resin (BR-85, Mitsubishi Rayon Co., Ltd.) | 19.8 parts by weight |
| Nylon filler (MW-330, SHINTO PAINT CO., LTD.) | 0.6 parts by weight |
| Methyl ethyl ketone | 39.8 parts by weight |
| Toluene | 39.8 parts by weight |

On the acceptance layer of the above substrate (thermal transfer image receiving sheet), sublimation transfer was performed by means of a thermal head by use of the above-described thermal transfer sheet of the sublimation transfer type to form a full-color image.

Formation of protective transfer layer

Then, the protective transfer layer was transferred from the aforementioned thermal transfer sheet (Examples 1 to 7, Comparative Example) to the substrate (thermal transfer image receiving sheet) so as to cover the so formed full-color image, thereby preparing printed matter as shown in FIG. 5.

The amount of static electricity generated during transfer of the protective transfer layer onto the substrate (thermal transfer image receiving sheet) was measured. The results are shown in Table 1.

The values of the surface electrical resistance of the printed matter having the protective transfer layer transferred onto the image were measured by the use of a surface electrical conductivity measuring device of Mitsubishi Petrochemical Co., Ltd. The results are shown in Table 1.

As described in detail above, the thermal transfer sheet of the present invention has a protective transfer layer provided in at least part of one of the surfaces of a base sheet via a release layer so as to be peelable, at least one of the release layer and the protective transfer layer containing an antistatic agent. Thus, generation of static electricity during peeling of the protective transfer layer can be suppressed. Furthermore, since an antistatic agent is contained in the protective transfer layer, a material as a transfer image support is given excellent antistatic properties by the protective transfer layer transferred onto this material. Consequently, poor transport of the material as a transfer image support in a thermal printer can be prevented. Printed matter having such protective transfer layer transferred onto an image gains excellent antistatic properties.

What is claimed is:

1. A thermal transfer sheet comprising:

a base sheet, and a protective transfer layer provided in at least part of one of the surfaces of the base sheet so as to be peelable, said protective transfer layer containing an antistatic agent comprising a conductive metal oxide comprising zinc antimonate ($ZnO.Sb_2O_5$).

2. The thermal transfer sheet of claim 1, wherein the protective transfer layer comprises a laminate.

3. The thermal transfer sheet of claim 1, wherein the protective transfer layer comprises a laminate consisting of a protective layer, an antistatic layer containing an antistatic agent, and an adhesive layer formed on the release layer in this order.

4. The thermal transfer sheet of claim 1, wherein the antistatic agent further comprises a conductive resin, and/or a surface active agent.

5. The thermal transfer sheet of claim 4, wherein the surface active agent is a quaternary ammonium salt.

TABLE 1

| Thermal transfer sheet | Presence or absence of antistatic agent: Release layer | Presence or absence of antistatic agent: Protective layer | Surface electrical resistance of thermal transfer agent (Ω/□) | Static voltage during transfer of protective transfer layer (V) | Surface electrcal resistance of printed matter (Ω/□) |
|---|---|---|---|---|---|
| Example 1 | Present | Absent | $10^8$ | −0.1 | $10^{11}$ |
| Example 2 | Present | Absent | $10^8$ | −0.2 | $10^{10}$ |
| Example 3 | Present | Present | $10^8$ | −0.2 | $10^9$ |
| Example 4 | Absent | Present | $10^8$ | −0.1 | $10^9$ |
| Example 5 | Present | Present | $10^8$ | −0.2 | $10^8$ |
| Example 6 | Absent | Present | $10^8$ | −0.2 | $10^8$ |
| Example 7 | Present | Present | $10^8$ | −0.2 | $10^9$ |
| Comparative Example | Absent | Absent | $10^{12}$ or more | −10 | $10^{12}$ or more |

As shown in Table 1, the thermal transfer sheets of the present invention (Examples 1 to 7) were confirmed to have very low surface electrical resistance values than the thermal transfer sheet containing no antistatic agent (the control). When the thermal transfer sheets of the present invention (Examples 1 to 7) were used, the amount of static electricity generated during transfer and the values of surface electrical resistance of printed matter were confirmed to be much smaller than when the thermal transfer sheet (the control) was used. Furthermore, the printed matter using the thermal transfer sheet of the present invention containing an antistatic agent in the protective transfer layer (i.e., Examples 3 to 7) had even lower values of surface electrical resistance, showing that excellent antistatic properties were imparted thereto.

6. The thermal transfer sheet of claim 1, wherein the zinc antimonate has a particle size in the range of 10 to 100 nm.

7. The thermal transfer sheet of claim 1, further comprising a dye layer having one or more colors formed on the base sheet.

8. The thermal transfer sheet of claim 7, wherein the dye layer and the protective transfer layer are formed in a coplanar, alternate manner.

9. A thermal transfer sheet comprising:

a base sheet, and a protective transfer layer provided in at least part of one of the surfaces of the base sheet through a nontransferable release layer so as to be peelable, at least one of said release layer and said protective transfer layer containing an antistatic agent comprising a conductive metal oxide comprising zinc antimonate ($ZnO.Sb_2O_5$).

10. Printed matter comprising:

a substrate, an image formed on at least one of surfaces of the substrate by a sublimation transfer process, and a protective transfer layer provided so as to cover at least part of the image, said protective transfer layer being a protective transfer layer formed by transfer using the thermal transfer sheet of claim 1.

* * * * *